United States Patent [19]

Dash

[11] Patent Number: 4,928,940

[45] Date of Patent: May 29, 1990

[54] APPARATUS AND METHOD FOR PRINTING SEPARATING CONTINUOUS FORMS INTO FOLDED DISCRETE JOBS INCLUDING ACCUMULATOR

[75] Inventor: Thomas E. Dash, Aurora, Ill.

[73] Assignee: Wallace Computer Services, Inc., Hillside, Ill.

[21] Appl. No.: 306,100

[22] Filed: Feb. 6, 1989

[51] Int. Cl.[5] ..... B41F 13/54

[52] U.S. Cl. ..... 270/1.1; 270/4; 270/21.1; 270/39; 270/52

[58] Field of Search ..... 270/1.1, 21.1, 30, 31, 270/32, 39, 52.5, 4; 493/409–411, 413–416

[56] References Cited

U.S. PATENT DOCUMENTS 3,707,063 12/1972 McIntyre ..... 493/414
4,427,404 1/1984 Yamada ..... 493/414
4,730,762 3/1988 Felix ..... 270/39

OTHER PUBLICATIONS

"High-Speed Forms Stacker", Lee, *IBM Technical Brochure*, vol. 15, No. 7, Dec. 1972.

*Primary Examiner*—Robert E. Garrett
*Assistant Examiner*—Therese M. Newholm
*Attorney, Agent, or Firm*—Tilton, Fallon, Lungmus & Chestnut

[57] ABSTRACT

Apparatus and method for printing and separating continuous forms into discrete folded jobs from a single moving web including an accumulator positioned between a printer and job separator with the accumulator being constructed to accumulate a portion of the web in random loops whenever the job separator operates at a capacity less than the printer.

5 Claims, 2 Drawing Sheets

APPARATUS AND METHOD FOR PRINTING SEPARATING CONTINUOUS FORMS INTO FOLDED DISCRETE JOBS INCLUDING ACCUMULATOR

BACKGROUND AND SUMMARY OF INVENTION

This invention relates to apparatus for printing, and separating continuous forms into discrete jobs including an accumulator and more particularly, to a unique accumulator which features storage of a continuous web in random loops.

This invention finds utility particularly in connection with high speed printers of the impact or preferably laser type. These printers operate at high speed and a problem has existed in the past relative to separating the output into discrete jobs. That problem has been solved by U.S. Pat. No. 4,846,454, and reference thereto may be had for additional details of construction and operation.

A further problem still exists and that has been the need for storage between the printer and the job separator. Heretofore, this has been achieved through the use of a relatively expensive folder. The folder, in addition to being expensive, also occupies considerable space. It will be appreciated that space normally is at a premium in the plants of users of impact printers—that high speed is not to be obtained by the sacrifice of space.

I have found that the folder is unnecessary and, in fact, a relatively inexpensive and compact accumulator can be employed to great advantage in the operation of a laser printer/job separator.

In particular, the accumulator of the instant invention includes a bin to which a continuous web is fed from the printer and from which the web is removed for the job separator. The accumulator bin is constructed and arranged to accumulate a portion of the web in random loops. Although random loops have been used in such applications as typewriter ribbons where the web is endless, there has been no suggestion of utilizing this phenomenon for an accumulator in connection with web advancement.

Other objects and advantages of the invention may be seen in the details of the ensuing specification.

The invention is described in conjunction with an illustrative embodiment in the accompanying drawing, in which FIG. 1 is a perspective view, somewhat schematic, of the printer-accumulator-job separator line constructed according to the instant invention;

DETAILED DESCRIPTION

Figure 1:
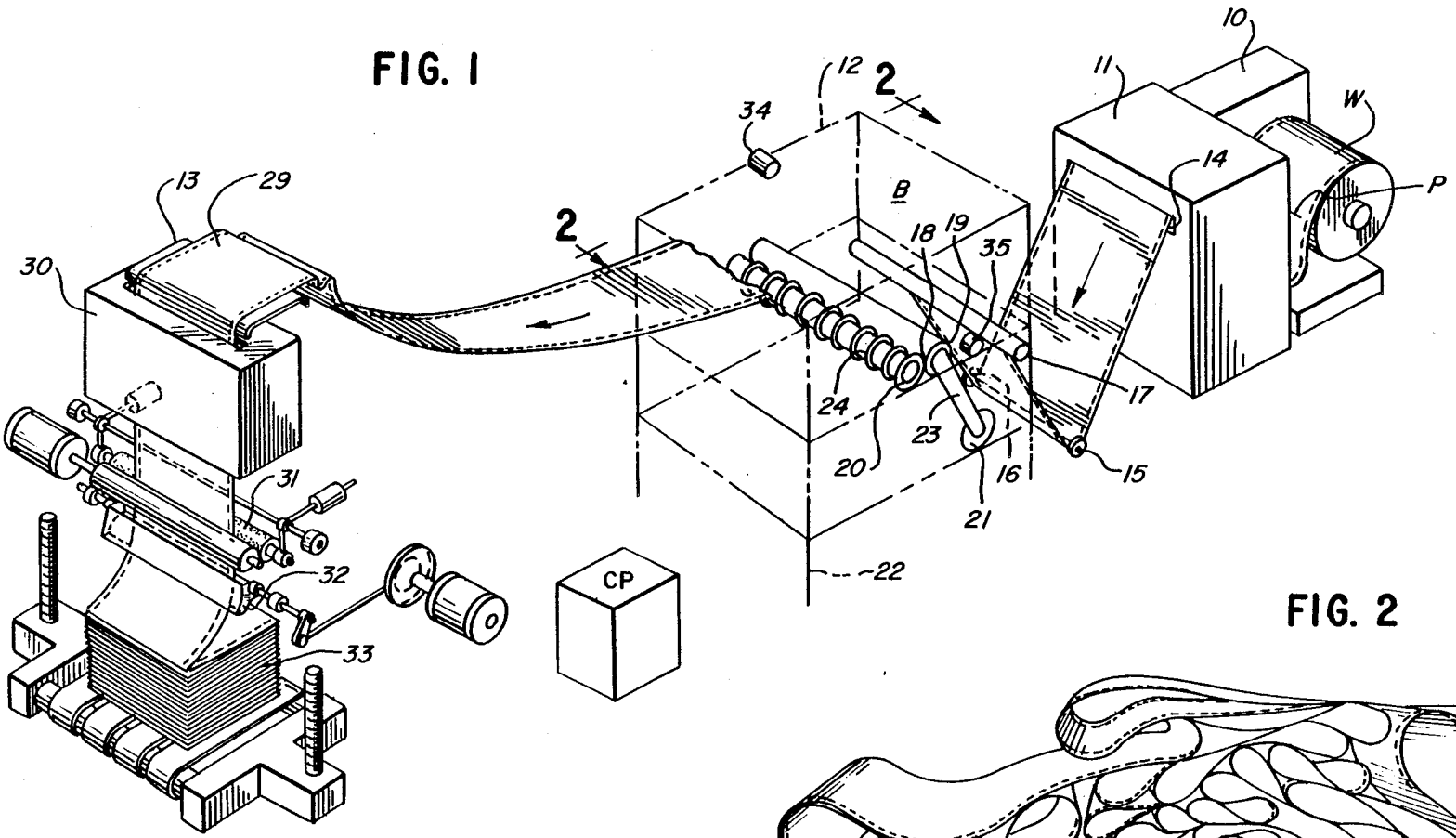

Referring first to FIG. 1 the symbol W refers to a web which is equipped along the longitudinal edges thereof with conventional line holes providing control punch margins. Additionally, the web may be equipped with lines of cross perforation as at P so as to facilitate the development of zig-zag folds in the continuous web as can be appreciated from the extreme lower left hand portion of FIG. 1.

In FIG. 1, starting at the right hand side, the numeral 10 designates generally an unwind mechanism for a parent roll of web material which is fed to a printer designated 11 and which advantageously may be of the laser type, previously mentioned. From the printer 11 the issuing web is delivered to the accumulator 12 and thence to the job separator 13.

The web W in issuing from the printer as at 14 is directed around a stationary turning shaft 15 and around further shafts or rolls as at 16 and 17 into the nip 18 between a pair of pull rolls 19 and 20. The pull roll 19 is a driven roll and the pull roll 20 is an idler.

Figure 3:
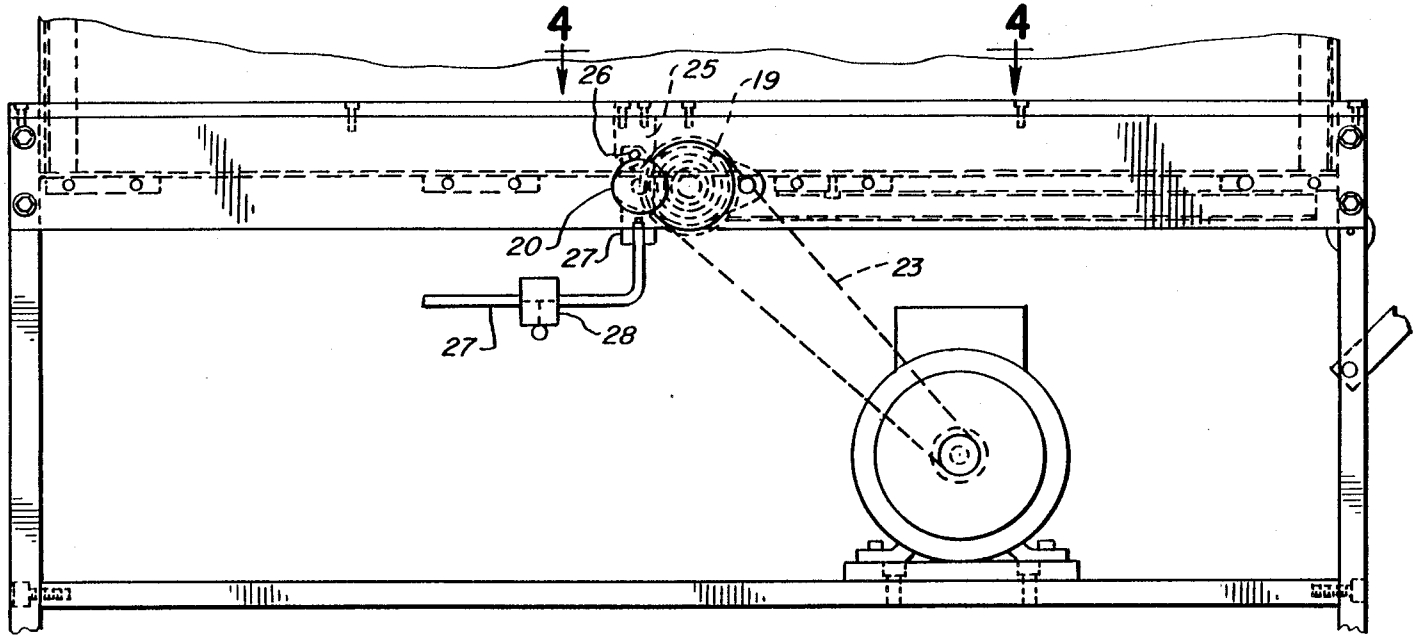
FIG. 3 is a fragmentary side elevational view of the accumulator portion of the instant invention.

As can be seen in FIG. 1 a motor 21 is provided on part of the frame 22 which defines the path of advance for the web W and the motor 21 is equipped with a pulley and cog belt system 23 for driving the driven pull roll 19. (see also FIG. 3).

Figure 4:
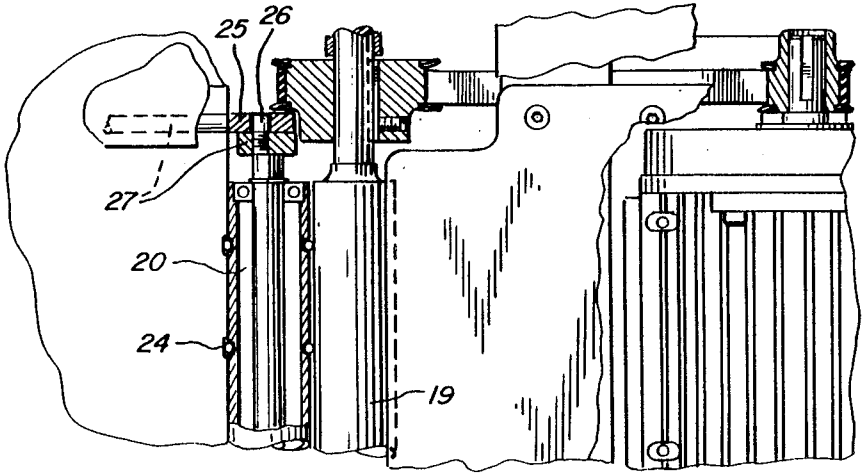
FIG. 4 is a fragmentary top plan view such as would be seen along the sight line 4—4 applied to FIG. 3.

The idler pull roll 20 is equipped with spaced O-rings 24—see also FIG. 4—which protrude from the peripheral surface of the pull roll 20 and have bearing contact with the driven pull roll 19.

The bearing contact between the idler pull roll 20 and the driven pull roll 19 is achieved by a pivotal mounting provided by a bracket 25 (see FIG. 3) which has an inwardly extending axle 26 projecting therefrom. Mounted on the axle 26 is a pivot bracket 27 which carries the idler pull roll 20 and the bearing contact is established by an arm or handle 27 which carries a counterweight 28 tending to pivot the idler pull roll 20 into bearing contact with the driven pull roll 19.

OPERATION

In the operation of the device, a web is fed around the stationary shafts or rolls 15–17 into the nip 18 and thereafter into the fold former 29 provided as part of the job separator 13. This merely is the folding performed subsequently. Thereafter, the web passes through a housing 30 which carries a transverse severing means described in connection with the above mentioned Parkander application.

Subsequently, the web passes through pull rolls as at 31 and to an oscillating chute 32 which develops the zig-zag folded pack 33, i.e., performs the actual folding operation. In the illustration given, there is a discrete stopping of the movement of the web incident to transverse cutting in the housing 30, this being under the control of the control panel CP.

Figure 2:
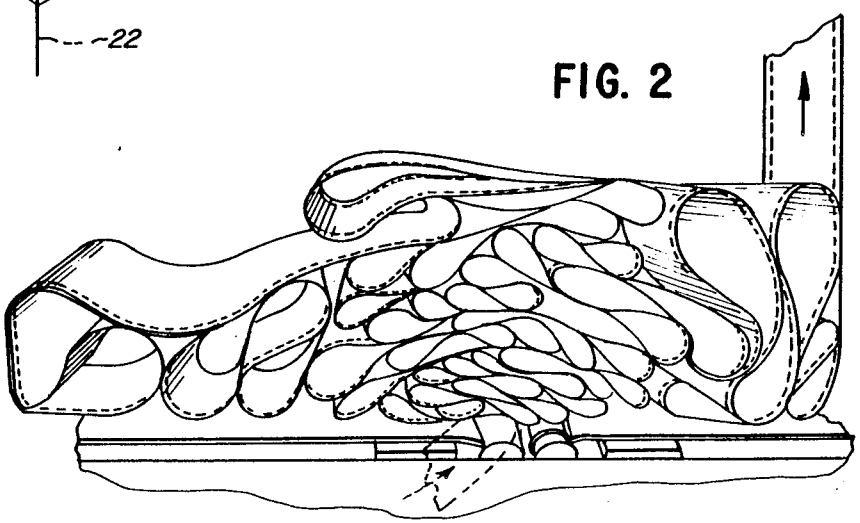
FIG. 2 is a fragmentary perspective view of the interior of the bin portion of the accumulator showing the random loops generated therein and which are stored or accumulated for subsequent use.

When the web is stopped in its advancement through the job separator 13, provision is made in the accumulator 12 for the accumulation of the additional length of web in the fashion depicted in FIG. 2. Should the accumulated web become so great as to rise to the level of the sensor 34 (still referring to FIG. 1), a signal is sent to shut down the printer 11.

On the other hand, when the accumulated web is so small in volume so as not to interrupt the beam from the sensor 35 adjacent the bottom of the bin B of the accumulator 12, a signal is delivered to the job separator 13 to stop the same. The inventive apparatus has a printer which is equipped with means for advancing the web at a predetermined speed and the job separator is equipped with means for advancing the web therethrough at a speed greater than the aforesaid mentioned predetermined speed. The job separator is also equipped with means for stopping the web advance incident to transverse severing of the webs so as to define a job with the accumulator being operative to accumulate random loops during the transverse severance. As indicated above, the accumulator is equipped with an open-topped bin defined by side and bottom walls, a web-receiving slot in the bottom wall, web feed rolls operatively associated with the slot and sensor means operatively associated with the top and bottom of the bin for deactivating respectively the job separator and printer.

Through the provision of the pull rolls 19, 20, a friction feed is developed which will not rupture the web when the same is under tension.

The pull or feed rolls 19, 20 are arranged to friction-feed the web into the bin with the rolls being equipped with counterweight means to facilitate slippage of the web past the rolls whenever the web between the feed rolls and printer is under tension. For this purpose, the feed rolls 19, 20 include a driven roll 19 and an idler roll 20 arranged in bearing contact with the driven roll, the idler roll having a plurality of axially spaced O-rings protruding from its periphery to provide the bearing contact.

While in the foregoing specification a detailed description of an embodiment of the invention has been set down for the purpose of illustration, many variations in the details hereingiven may be made by those skilled in the art without departing from the spirit and scope of the invention.

I claim:

1. A method of printing and separating continuous forms into discrete jobs from a single moving web comprising the steps of advancing said web through a printer at a predetermined speed and thereafter through a job separator at a speed higher than said predetermined speed, cyclically interrupting the advance of said web through said job separator to develop separate stacks of folded web, during said interruption accumulating a length of said web in random loops arrangement in bin means interposed between said printer and said job separator, and sensing the level of the random loops in said bin means for controlling said printer and job separator.

2. Apparatus for printing and separating continuous forms into discrete jobs from a single moving web, comprising frame means providing a path of web travel, a printer, an accumulator and a job separator arranged sequentially in said path, said accumulator being constructed and arranged to accumulate a portion of said web in random loops whenever said job separator operates at a capacity less than said printer, said printer being equipped with means for advancing said web therethrough at a predetermined speed, said job separator being equipped with means for advancing said web therethrough at a speed greater than said predetermined speed, said job separator also being equipped with means for stopping the web advance incident to transverse severing of said web to define a job, said accumulator being operative to accumulate random loops during said transverse severing, said accumulator being equipped with an open-topped bin defined by side and bottom walls, a web-receiving slot in said bottom wall, web feed rolls operatively associated with said slot, and sensor means operatively associated with the top and bottom of said bin for deactivating respectively said printer and job separator.

3. The apparatus of claim 1 in which said feed rolls are arranged to friction-feed said web into said bin, said feed rolls being equipped with counter weight means to facilitate slippage thereof past said web whenever the web between said feed rolls and printer is under tension.

4. The apparatus of claim 1 in which said feed rolls include a driven roll and an idler roll arranged in bearing contact with said driven roll, said idler roll having a plurality of axially-spaced O-rings protruding from its periphery to provide said bearing contact.

5. A method of printing and separating continuous forms into discrete jobs from a single moving web comprising the steps of advancing said web through a printer at a predetermined speed and thereafter through a job separator at a speed higher than said predetermined speed, cyclically interrupting the advance of said web through said job separator to develop separate stacks of folded web, during said interruption accumulating a length of said web in random loop arrangement in a bottom-fed, open-topped bin interposed between said printer and said job separator, and continuously sensing the level of random loops in said bin and stopping said printer when said level is too high and stopping said job separator when said level is too low.

* * * * *